US006461212B1

(12) United States Patent
Tsai

(10) Patent No.: US 6,461,212 B1
(45) Date of Patent: Oct. 8, 2002

(54) AUTOMATIC START CONTROL AND CLUTCH OF TOY ENGINE POWERED BY HIGH PRESSURE GAS

(76) Inventor: Yu-Chi Tsai, PO Box 23-487, Changhua City 500 (TW)

( * ) Notice: Subject to any disclaimer, the term of this patent is extended or adjusted under 35 U.S.C. 154(b) by 0 days.

(21) Appl. No.: 09/512,209

(22) Filed: Feb. 24, 2000

(30) Foreign Application Priority Data

Oct. 18, 1999 (TW) ..... 088217650

(51) Int. Cl.[7] ..... A63H 27/127

(52) U.S. Cl. ..... 446/37; 446/36; 446/38; 446/39; 446/34; 244/60; 244/17.11; 416/114; 416/153; 416/169 R; 192/12 R; 192/19; 192/111 A; 74/7 C

(58) Field of Search ..... 446/36, 37, 38, 446/39, 461, 463, 57, 58, 65; 192/9, 12 R; 188/31, 69, 20, 2 F, 196 B, 196 BA, 166; 416/169 R, 153; 74/7 C

(56) References Cited

U.S. PATENT DOCUMENTS 2,007,766 A * 7/1935 Linder
2,855,070 A * 10/1958 McRoskey et al.
2,875,554 A * 3/1959 Boultinghouse
3,111,785 A * 11/1963 McRoskey et al.
6,325,036 B1 * 12/2001 Gracyalny et al.

* cited by examiner

*Primary Examiner*—Derris H. Banks
*Assistant Examiner*—Ali Abdelwahed

(57) ABSTRACT

A starting device of a toy engine comprises a spring, a starting piece, and a unidirectional bevel gear. The motion of the spring between the two fulcrums serves to ensure that the control rod is kept securely in place at a disengaging position and an engaging position. The unidirectional bevel gear is mounted behind the engine propeller and is controlled by the starting piece to prevent the propeller from turning in reverse at the time when the engine is started. The clutch is formed of two clutch pieces which are mounted between the propeller and the engine head. One of the two clutch pieces is mounted on the front end of the propeller shaft for imparting the engine power. Other one of the two clutch pieces is mounted in front of the propeller. The two clutch pieces are symmetrical in construction to each other and are therefore capable of joining together to enable the propeller shaft to actuate the propeller to turn. The clutching mechanism of the two clutch pieces enables the engine propeller to remain in the idling state, thereby resulting in the conservation of power source during the flight of a toy airplane which is equipped with the toy engine.

4 Claims, 12 Drawing Sheets

AUTOMATIC START CONTROL AND CLUTCH OF TOY ENGINE POWERED BY HIGH PRESSURE GAS

FIELD OF THE INVENTION

The present invention relates generally to a toy airplane engine driven by high pressure gas, and more particularly to an automatic starting device and an idling clutch for the propeller of the toy airplane engine.

BACKGROUND OF THE INVENTION

The conventional toy airplane engines are generally propelled by the expansion force resulting from the gasification of the liquid carbon dioxide, or by the expansion force of the compressed air. The conventional toy airplane engines described above are defective in design in that their propellers may turn in reverse at such time when they are started by turning their propellers with the finger, which is vulnerable to injury by the propellers in motion. In addition, such conventional toy airplane engines are devoid of an idling clutch for propeller to afford the conventional toy airplanes the free flight which takes place without propulsion.

SUMMARY OF THE INVENTION

The primary objective of the present invention is to provide a toy engine free from the shortcomings of the conventional toy engines described above.

It is another objective of the present invention to provide a toy engine with an automatic start control and a clutch, which are integral parts of the structure of the present invention.

The starting device of the present invention is formed of a spring and a starting piece, which are mounted on the front end of the bearing of the engine propeller, and a unidirectional bevel gear mounted behind the engine propeller. The motion of the spring between the two fulcrums serves to ensure that the control rod is kept securely in place at a disengaging position and an engaging position. The unidirectional bevel gear is controlled by the starting piece to prevent the propeller from turning in reverse at the time when the engine is started. The clutch is formed of two clutching pieces which are mounted between the propeller and the engine head. One of the two clutching pieces is mounted on one end of the propeller shaft for imparting the engine power. Other one of the two clutching pieces is mounted in front of the propeller. The two clutching pieces are symmetrical in construction to each other and are therefore capable of joining together to enable the propeller shaft to actuate the propeller to turn. The clutching mechanism of the two clutching pieces enables the engine propeller to remain in the idling state, thereby resulting in the conservation of power source during the flight of the toy airplane.

The starting device of the present invention is optionally provided with an auxiliary device which is intended to prevent the starting piece from re-engaging the bevel gear in high speed motion after the starting piece has disengaged the bevel gear and has not yet stabilized, thereby averting an inevitable damage to the structure of the toy engine.

The foregoing objectives, features, functions, and advantages of the present invention will be more readily understood upon a thoughtful deliberation of the following detailed description of the embodiments of the present invention with reference to the accompanying drawings.

DETAILED DESCRIPTION OF THE PREFERRED EMBODIMENTS

Figure 1:
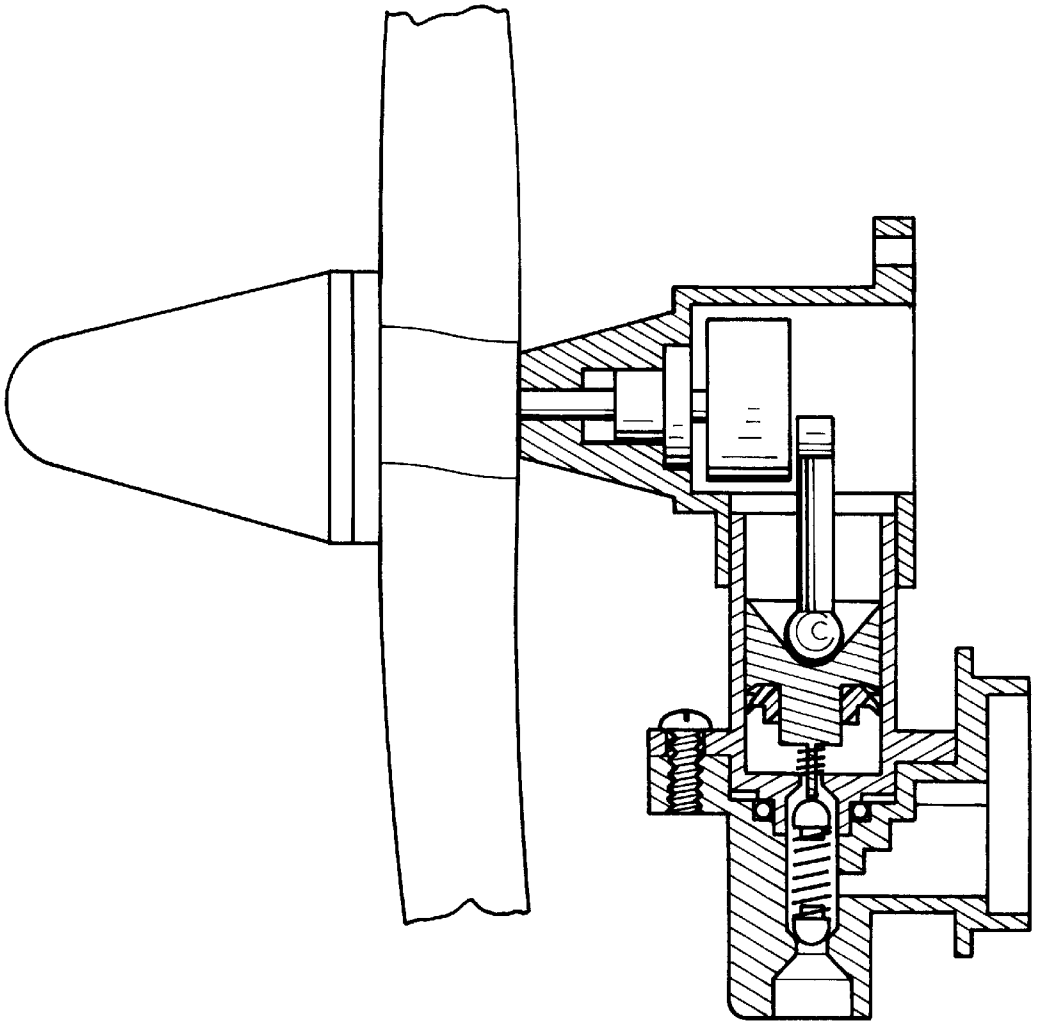
FIG. 1 shows a sectional schematic view of a gas-powered toy engine of the prior art.
Figure 2:
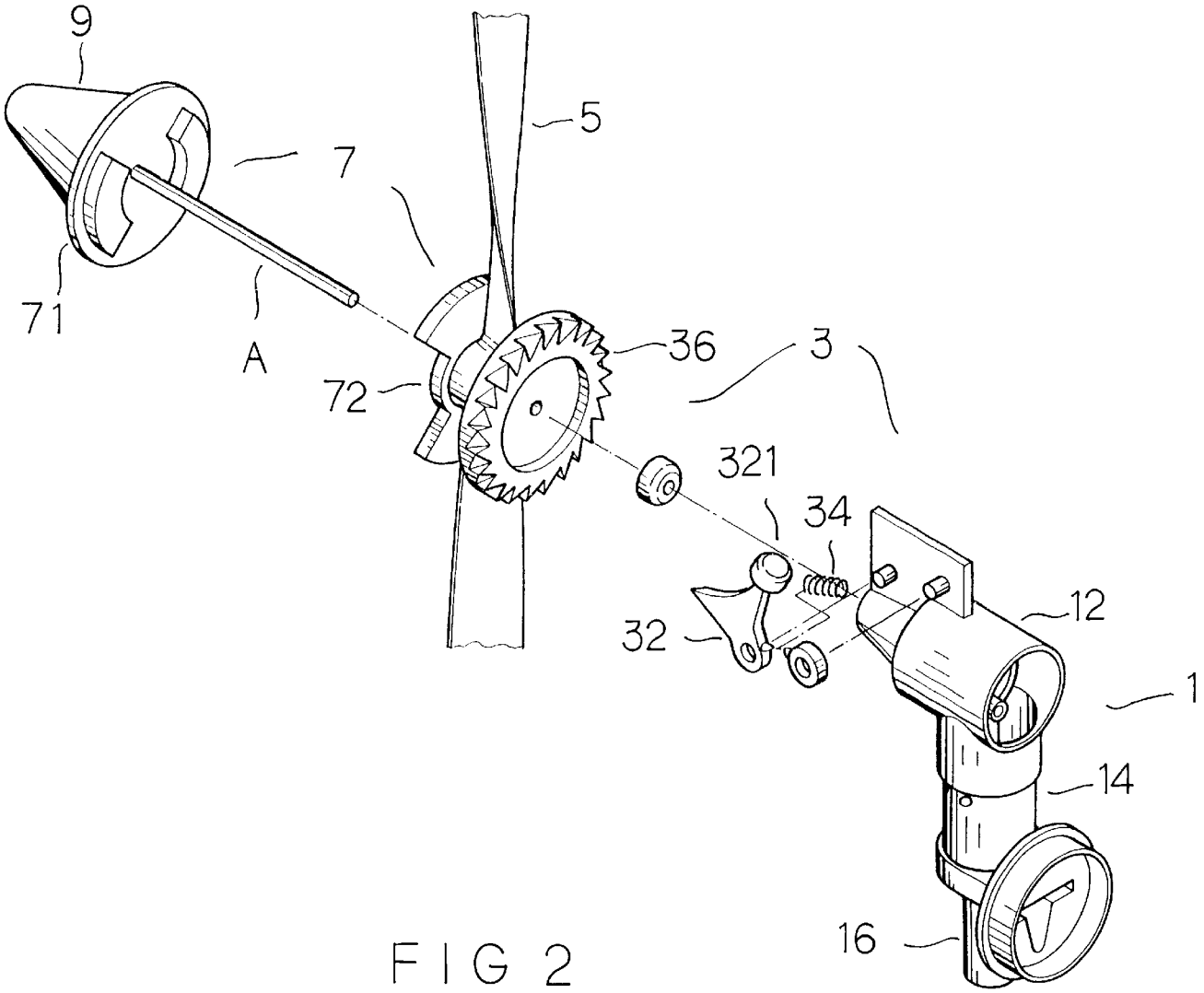
FIG. 2 shows an exploded view of a first preferred embodiment of the present invention.
Figure 3:
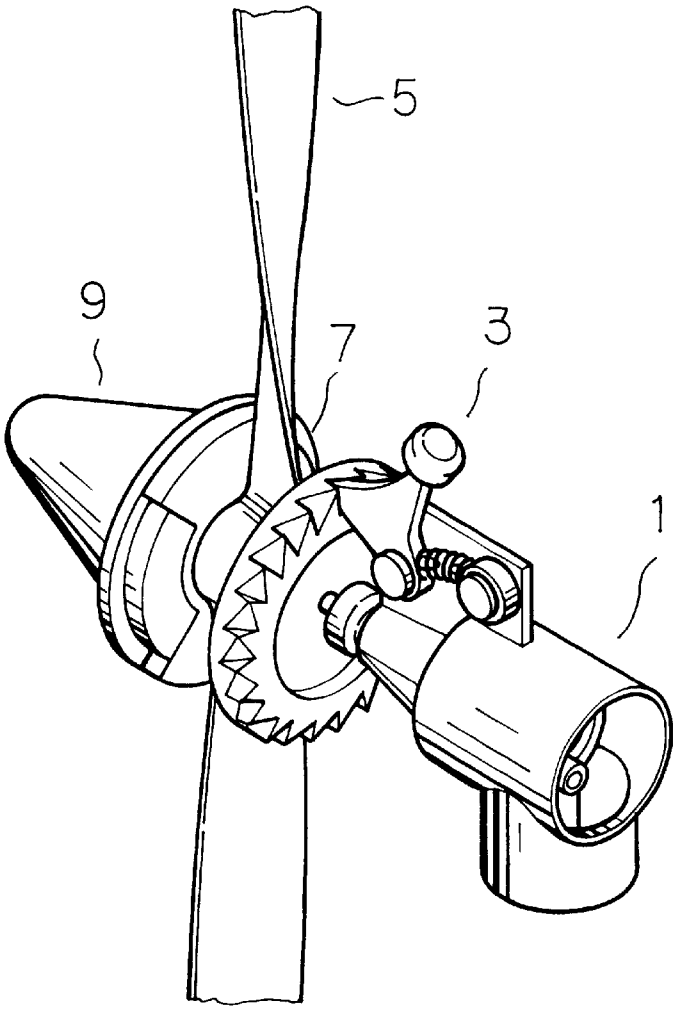
FIG. 3 shows a perspective view of the first preferred embodiment of the present invention in combination.

As shown in FIGS. 2–7, a gas-powered toy engine of the first preferred embodiment of the present invention comprises an engine main body 1, a starting device 3, a propeller 5, a clutch 7, and a head 9 fastened with one end of a propeller shaft A. The starting device 3 is fastened with the front end of the engine main body 1. The propeller 5 is mounted between the starting device 3 and the clutch 7. The above component parts are fastened together on the propeller shaft A. The head 9 is provided with internal threads, whereas one end of the propeller shaft A is provided with external threads. The head 9 is fastened with one end of the propeller shaft A such that the internal threads of the head 9 are engaged with the external threads of the propeller shaft A. In the event that the propeller 5 or the head 9 is damaged, it can be easily replaced. The propeller shaft and the head of the prior art engine are fixed such that the damaged head can not be replaced independently of the propeller shaft.

The engine main body 1 is formed of a propeller shaft chamber 12, a cylinder 14, and a gas valve chamber 16. In the propeller shaft chamber 12, the rear end of the propeller shaft A is fastened with an eccentric transmission wheel 123 and an eccentric transmission rod 125. The front end the propeller shaft A is fastened with the head 9 and a front clutch piece 71 which is formed integrally with the head 9.

The midsegment of the propeller shaft A is put through the shaft hole of the propeller 5 with an appropriate looseness, a rear clutch piece 72 formed integrally with the propeller 5, and a unidirectional bevel gear 36. The cylinder 14 is provided with a piston 143 which is connected with the eccentric transmission rod 125. The gas valve chamber 16 comprises a gas inlet 161, a gas valve 163, an inflation valve and a channel connecting air tank which are not the subject matters of the present invention.

Figure 4:
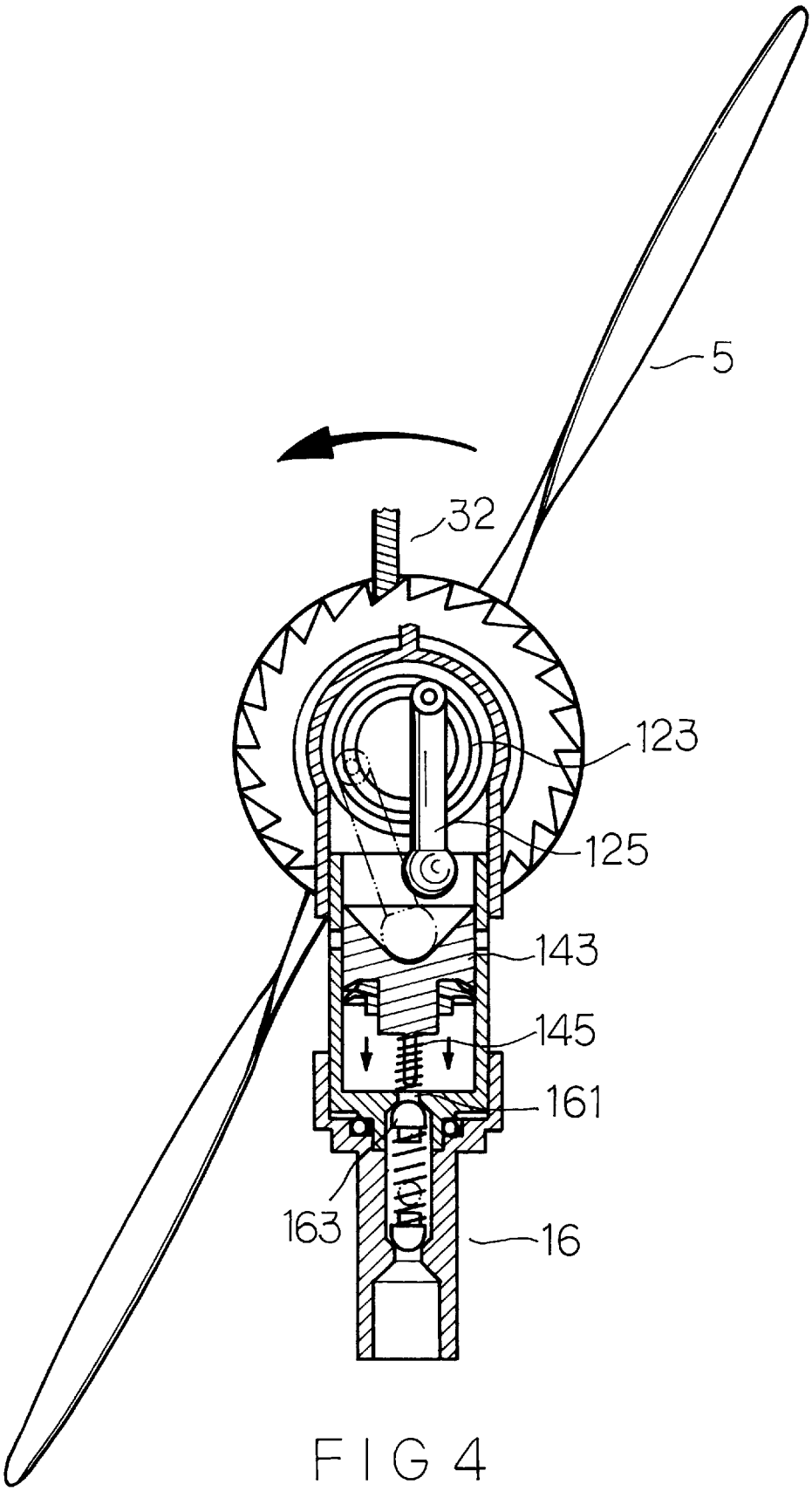
FIG. 4 is a sectional schematic view of the engine of the first preferred embodiment of the present invention to show that the starting piece continues to twist slowly the propeller to engage in the reverse operation while retaining the unidirectional bevel gear.

When the control rod 321 is pushed, the starting piece 32 is forced by the spring force of the spring 34 to engage the unidirectional bevel gear 36. As the propeller 5 is slowly turned in a direction indicated by an arrow, as shown in FIG. 4, the starting piece 32 moves through the gear 36. The piston 143 is pressed by the eccentric transmission rod 125 which is actuated by the eccentric transmission wheel 123. When the piston 143 arrives at the bottom dead point of the cylinder 14, the gas supply valve collision needle of the piston 143 has already opened up the gas supply valve 163.

Figure 5:
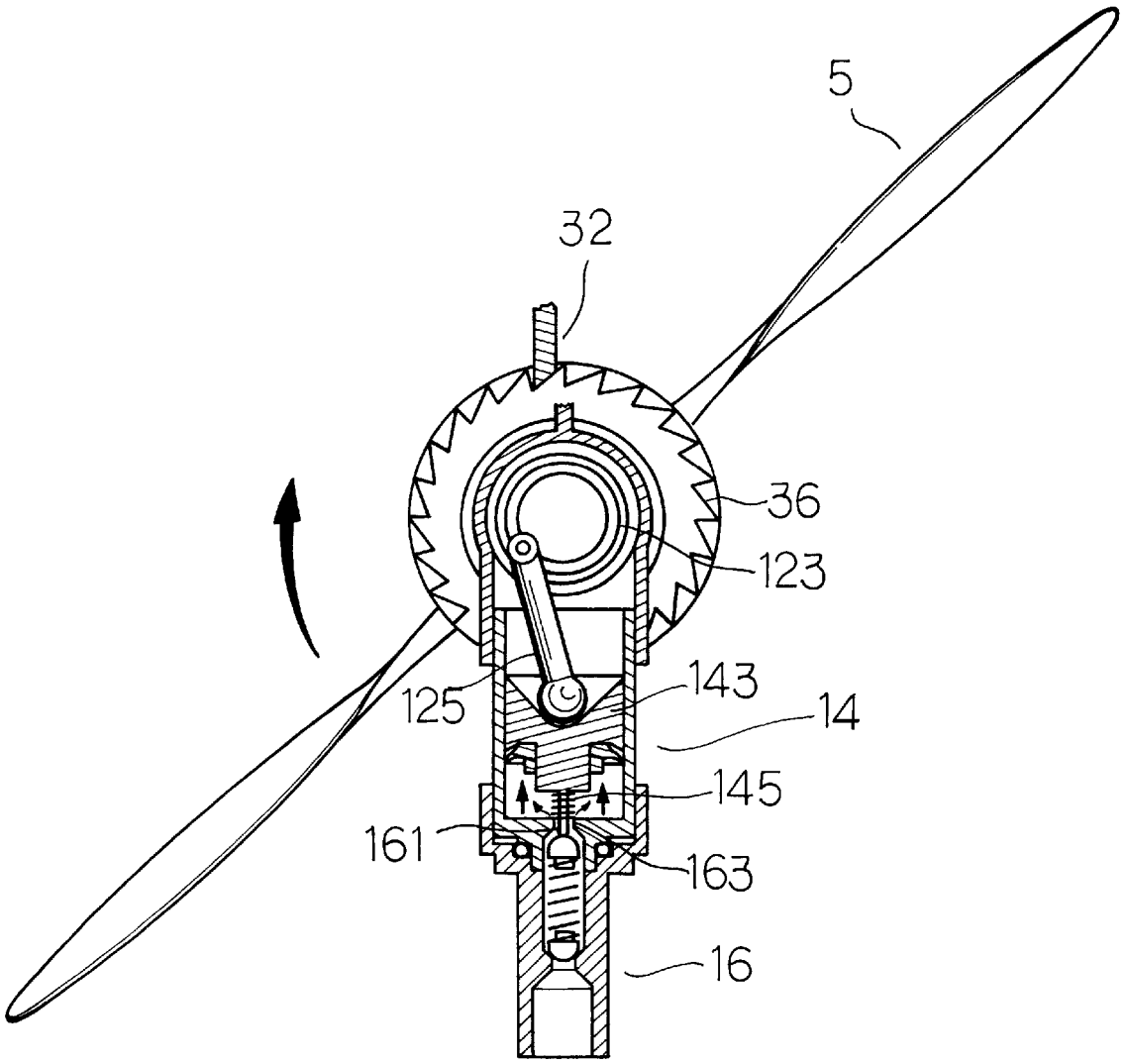
FIG. 5 is a sectional schematic view of the engine of the first preferred embodiment of the present invention to show that the propeller has gained a forward rotational force to complete the preparation of an automatic start of engine as a result of the back fire being locked out by the starting device.

As shown in FIG. 5, when the piston 143 has not yet arrived at the bottom dead point of the cylinder 14, the gas supply valve 163 is already opened up to allow the high pressure gas to enter the cylinder 14, thereby putting a great deal of pressure on the piston. The reaction force of the piston is imparted to the propeller 5 via the eccentric transmission rod 125 and the eccentric transmission wheel 123. A strong forward force is thus brought about by the initial reverse turning of the propeller 5. In the meantime, the starting piece 32 is caused by the forward force to lock out the vertical surface of the bevel gear 36. The gas supply valve collision needle 145 of the piston 143 is thus forced to open up the gas valve 163 earlier. The forward pressure of the cylinder 14 is corresponding to the pressure of the air tank. The forward rotational power available to the propeller 5 is at its peak.

Figure 6:
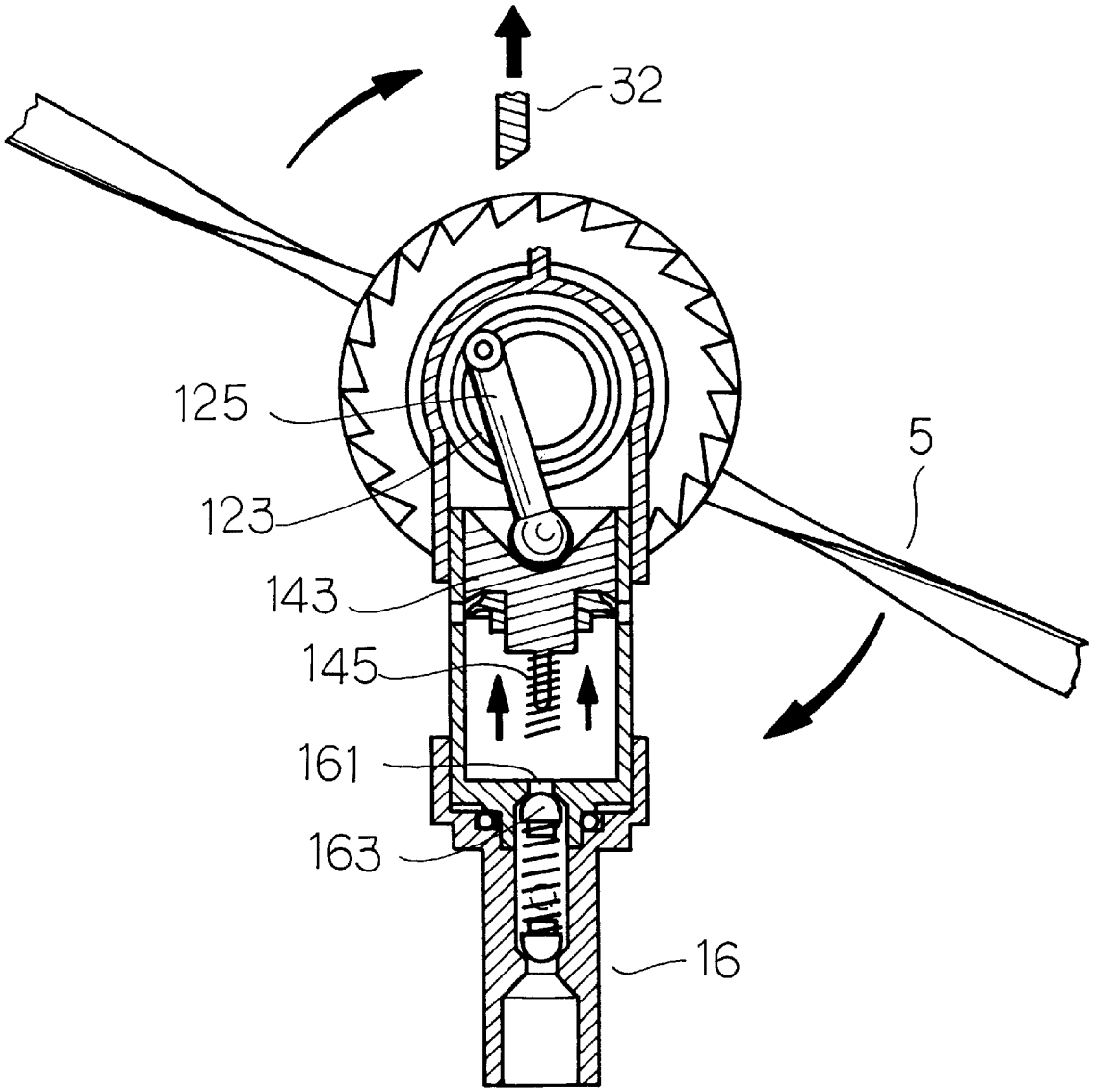
FIG. 6 is a sectional schematic view of the engine of the first preferred embodiment of the present invention to show the automatic start of the engine.
Figure 7:
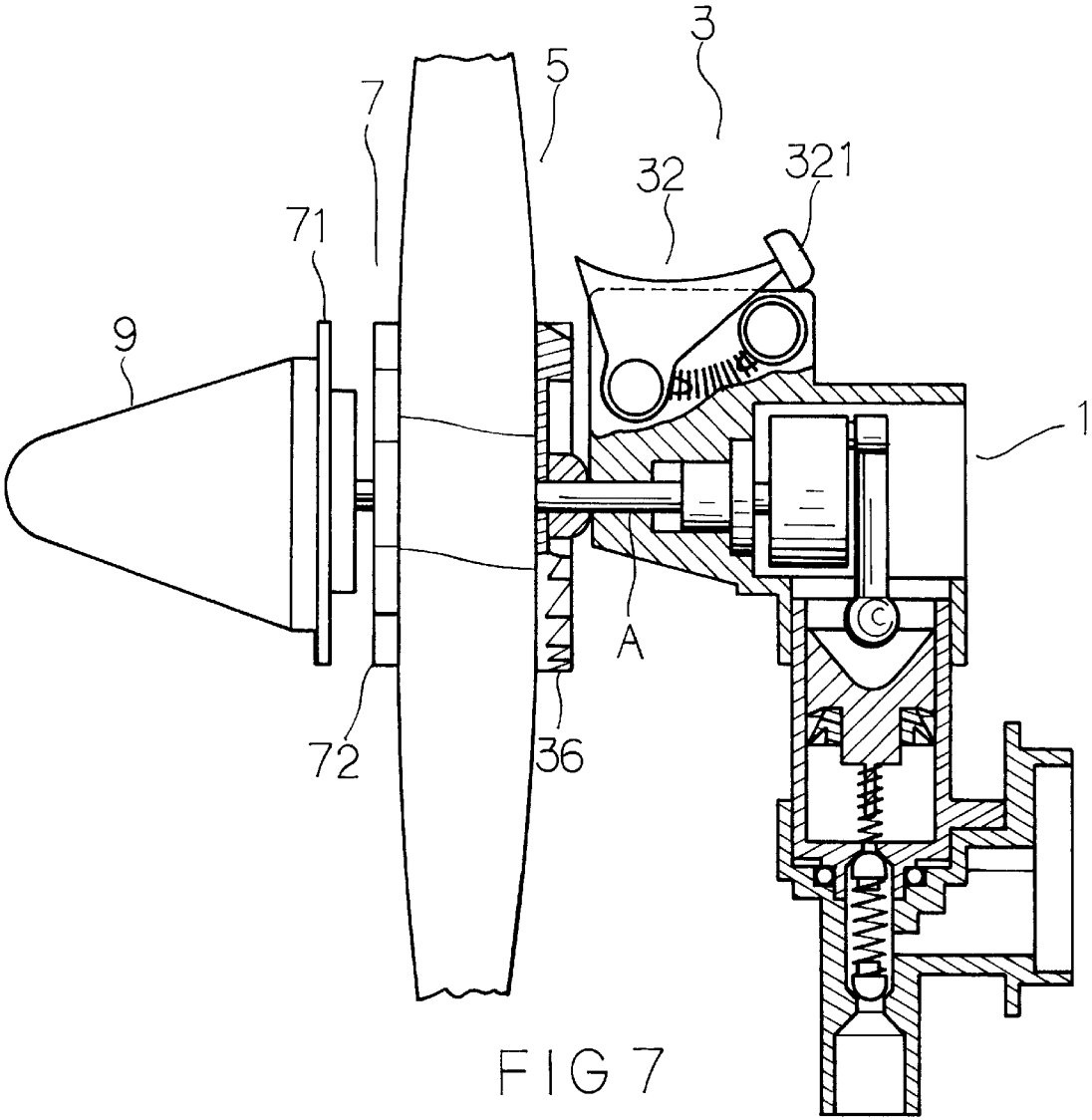
FIG. 7 shows a schematic view of the idling of the propeller of the first preferred embodiment of the present invention.

As shown in FIGS. 6 and 7, the control rod 321 is gently pushed to cause the spring 34 to act on the starting piece 32, which is thus disengaged with the bevel gear 36. The piston 143, which is locked out, is thus released. As a result, the strong forward force is made available to draw the propeller 5 to turn rapidly in the forward direction.

As shown in FIG. 7, the clutch 7 is formed of two pieces 71 and 72 which are symmetrically recessed and protruded. After the start of engine and before the take off, the two clutch pieces 71 and 72 are joined together by the force of the starting piece 32 engaging the bevel gear 36. After the take off, the starting piece 32 is disengaged with the bevel gear 36. The clutch pieces 71 and 72 are relieved of the pressure. However, the clutch pieces 71 and 72 are still joined together in view of the forward propulsion of the propeller being greater than the wind drag. As soon as the forward propulsion of the propeller becomes smaller than the wind drag because of the gradual decrease in the pressure of the air tank, the rear clutch piece 72 becomes disengaged with the front clutch piece 71. As a result, the propeller is in the idling state, as shown in FIG. 7.

Figure 5A:
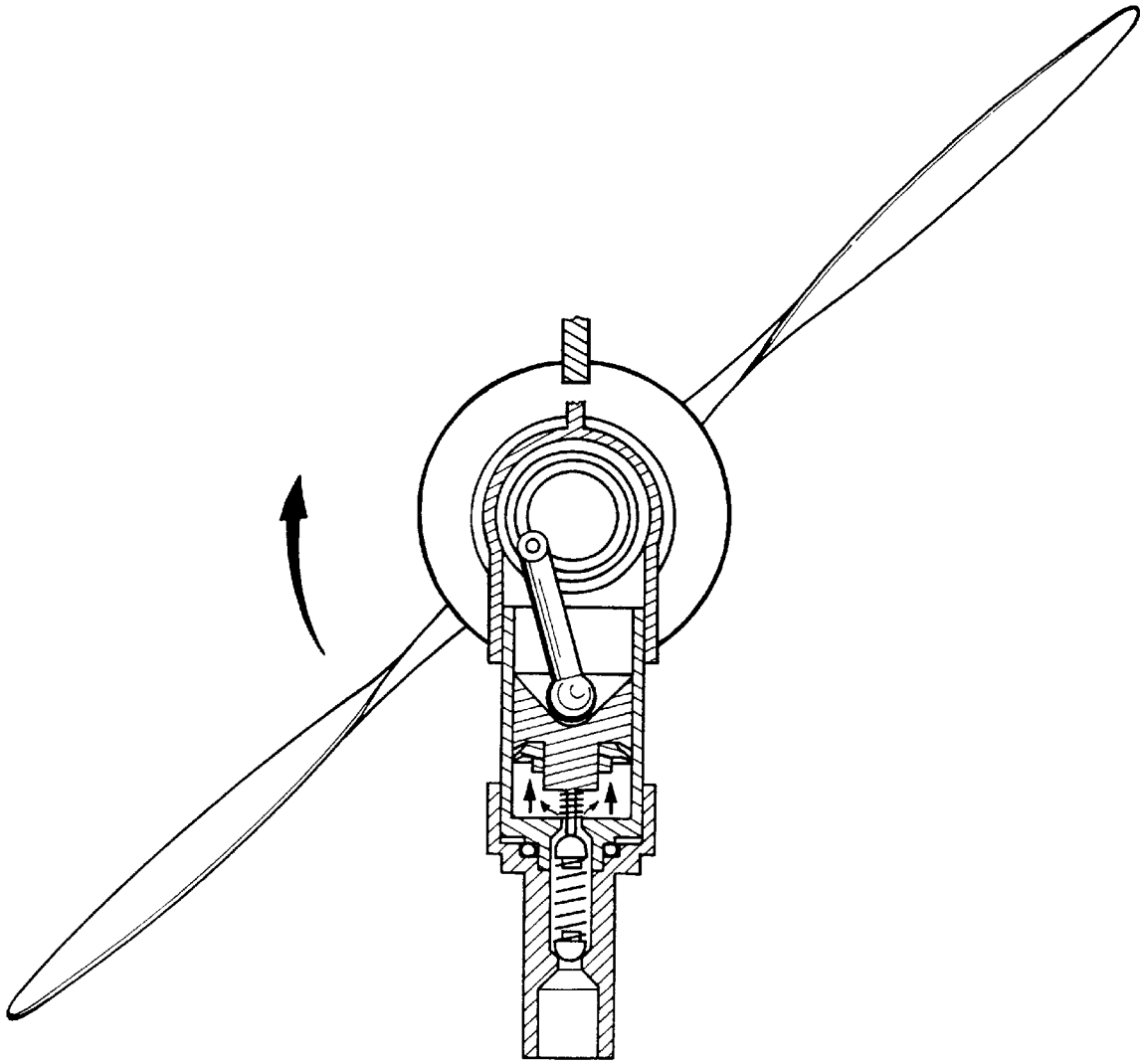
FIG. 5A is sectional schematic view of the engine of the another embodiment of the first preferred embodiment of present invention shown in FIG. 5.

The so-called "unidirectional bevel gear" is intended to meet the above-described braking and starting special purposes and is devoid of the engagement transmission function of the ordinary gear. The number of teeth depends on the design requirement and the engine output. The use of the multiple-toothed design in beneficial to the production process in which the both ends of the propeller shaft is provided with the random device in connection with the transmission member, thereby resulting in the reduction in production cost and enabling the consumer to search randomly the starting point of the piston, as shown in FIGS. 4 and 5. In case of the special requirement of design, the transmission member of the production process must be aligned in advance with precision. Under the finishing condition of the starting position shown in FIG. 5 for setting up the piston, the unidirectional bevel gear 36 may be designed as a structure comprising a single indentation as shown in FIG. 5A.

Figure 8:
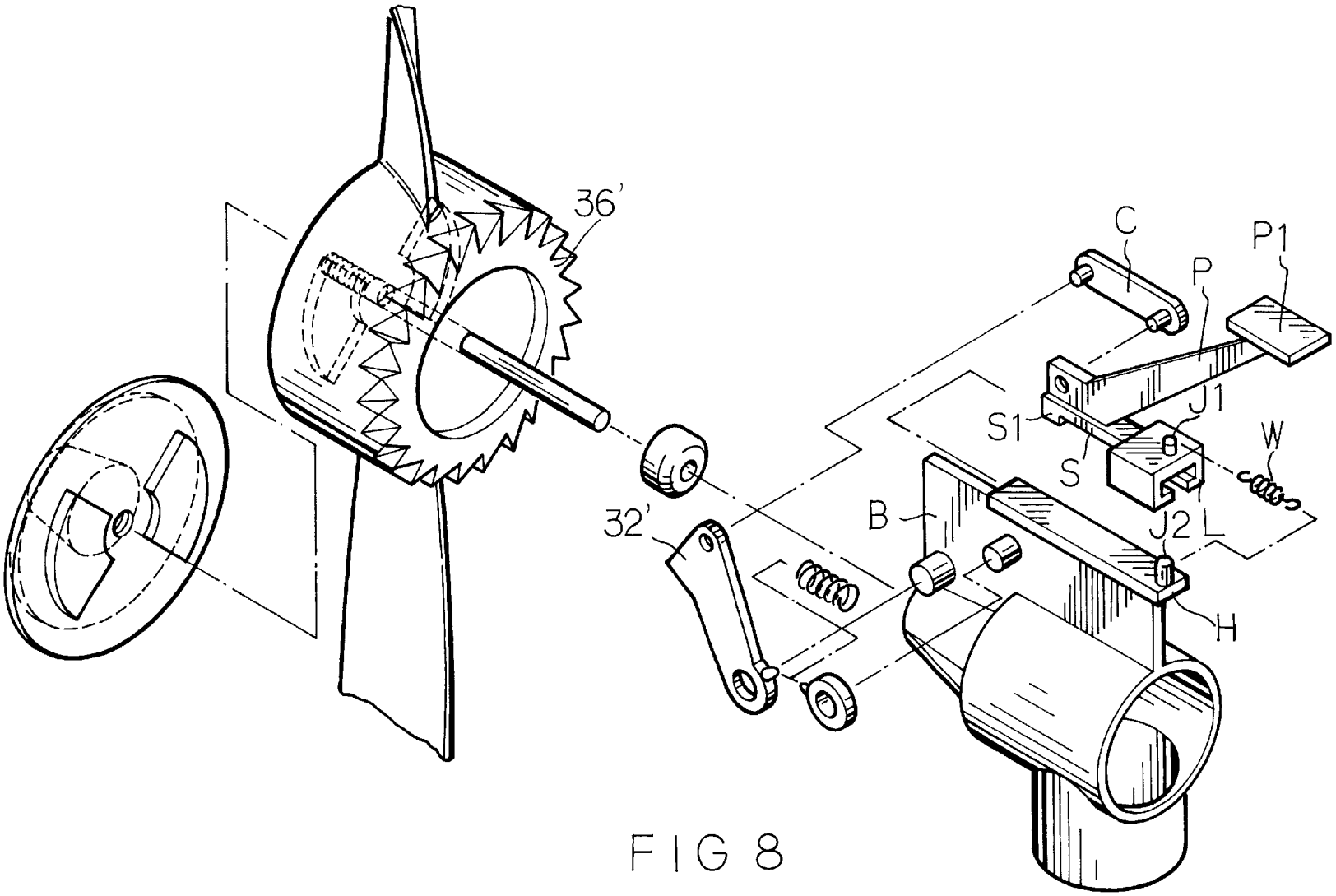
FIG. 8 shows an exploded view of a second preferred embodiment of the present invention.
Figure 9:
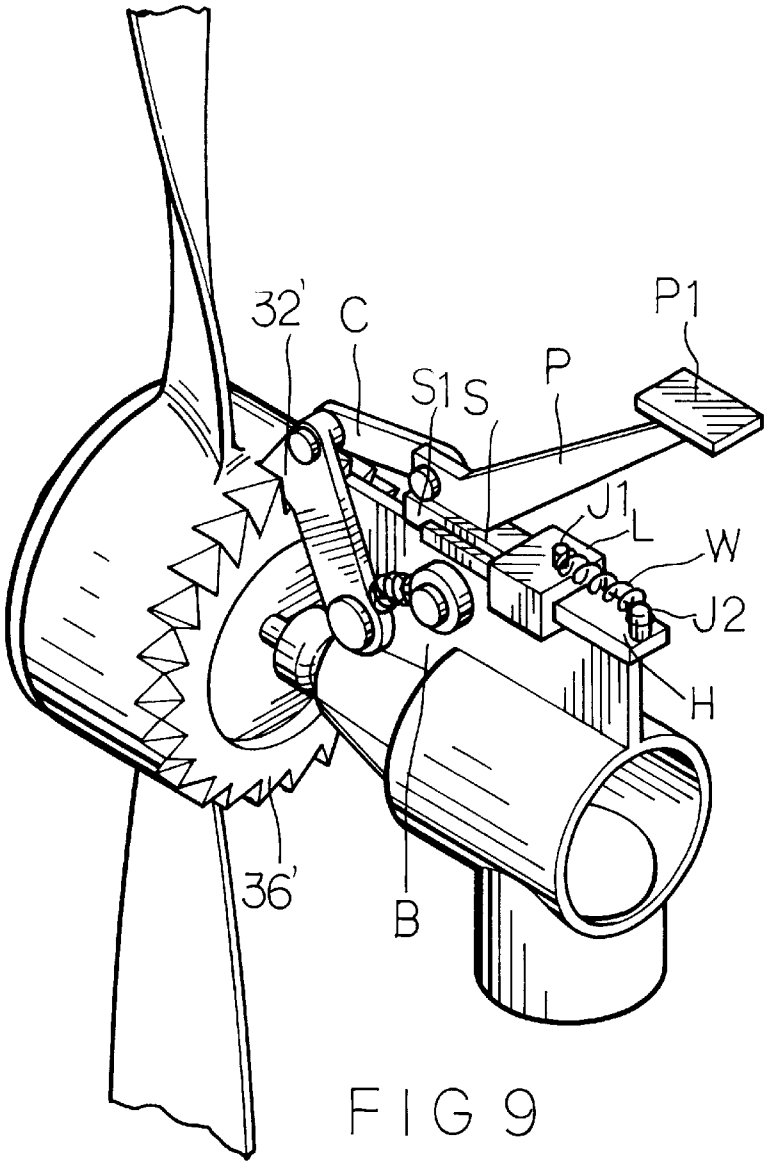
FIG. 9 shows a perspective view of the second preferred embodiment of the present invention in combination.

As shown in FIGS. 8 and 9, the present invention is provided with an auxiliary device which is disposed behind the starting device 3. The control rod 321 of the starting device 3 is replaced by a connection rod C which is movably connected at the front end thereof with the starting device 3 and is movably connected at the rear end thereof with an operation rod P having a press piece P1 and a thin piece S which is connected with a sliding piece L of an inverted U-shaped construction. The base B of the starting device is extended rearward and is then provided with a slide rail H on which the sliding piece L slides. The sliding piece L is provided at the rear end thereof with a hooked portion J1 which is engaged with one end of a compression spring W whose other end is engaged with a hooked portion J2 of the slide rail H. The thin piece S moves along with the sliding piece L on the slide rail H. In view of the thin piece S having a thickened front end S1, the thin piece S is caught at the front end of the slide rail H at the time when the thin piece S moves to the front end of the slide rail H. The operation rod P is fastened with the thin piece S. As a result, when the operation rod P is moved back and forth, the thin piece S and the sliding piece L slide along with the operation rod P.

Figure 10:
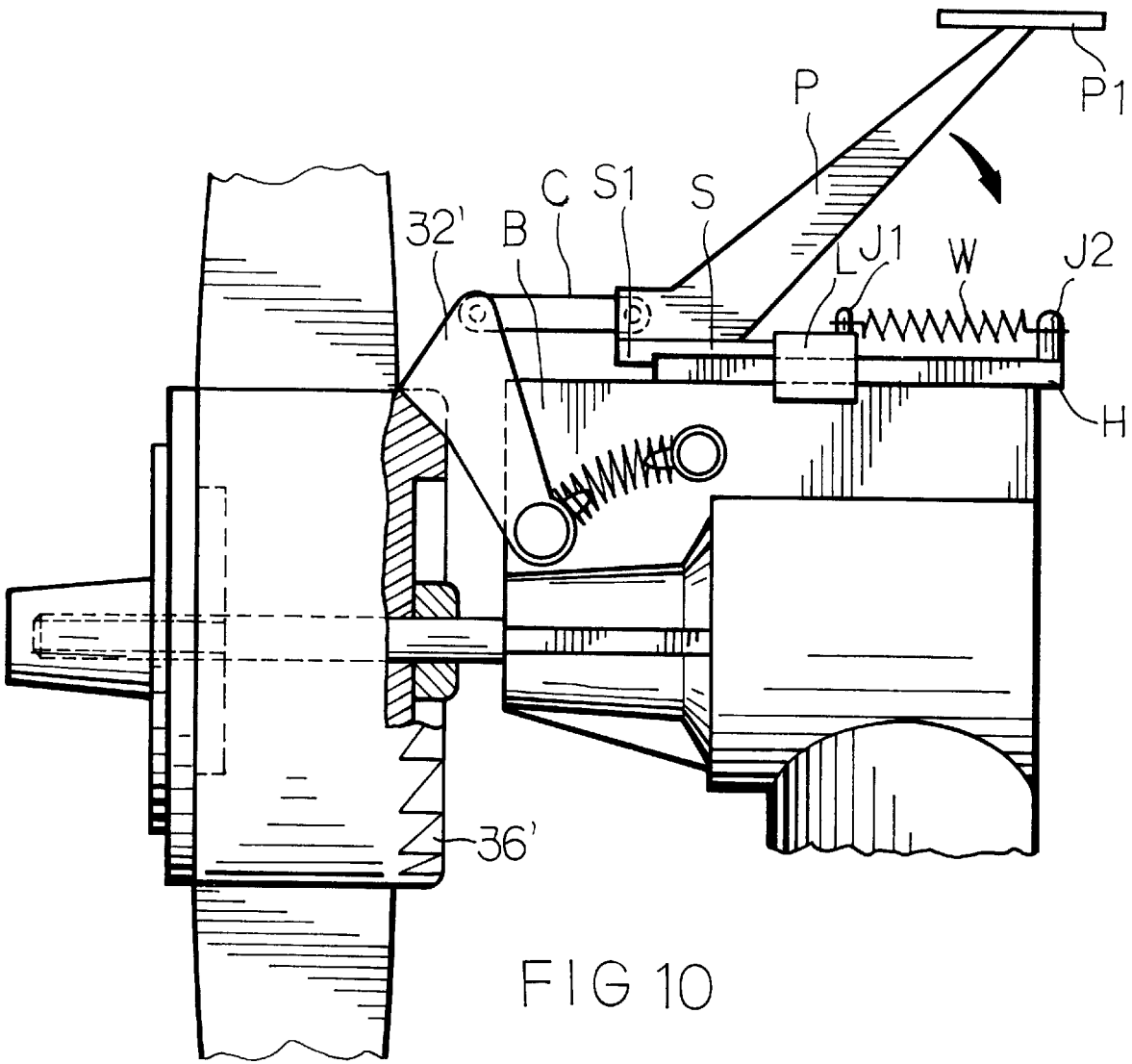
FIG. 10 is a sectional schematic view of the second preferred embodiment of the present invention to show that the starting piece is engaged with the unidirectional bevel gear and that the control rod is retained at the front end of the slide rail.

As shown in FIG. 10, the starting piece 32' is caused to engage the bevel gear 36' when the operation rod P is pulled. In the meantime, the operation rod P is retained by the rail H such that the thickened portion S1 of the thin piece S of the operation rod P is retained at the front end of the rail H.

Figure 11:
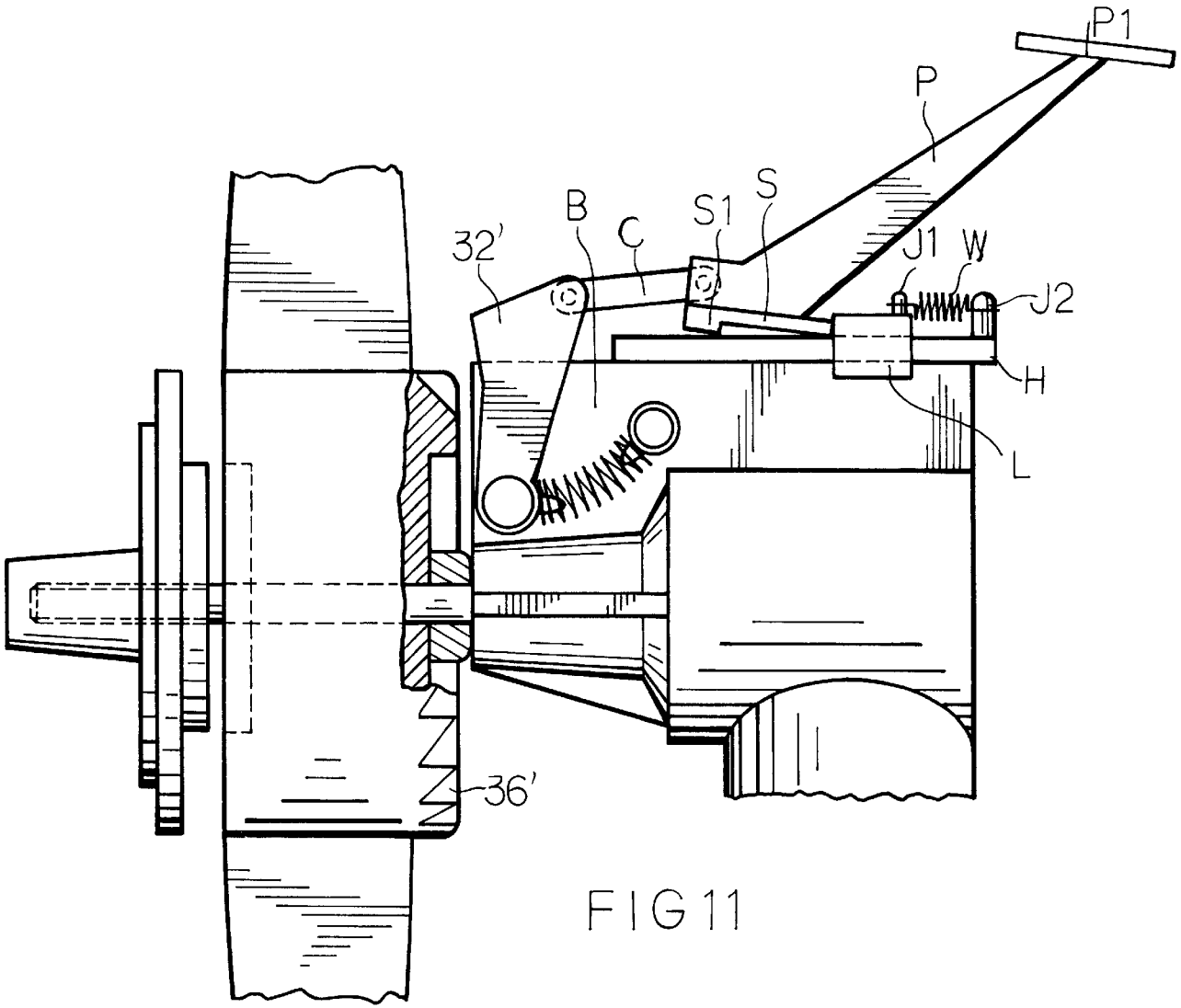
FIG. 11 is a sectional schematic view of the second preferred embodiment of the present invention to show that the starting piece is disengaged with the unidirectional bevel gear and that the control rod and the sliding piece move rearward.

In order to start the engine, the starting piece 32' must be disengaged with the bevel gear 36'. This is achieved by pressing the press piece P1 of the operation rod P, thereby causing the operation rod P to actuate the connection rod C to pull the starting piece 32' out of the bevel gear 36'. On the other hand, when the press piece P1 is pressed, the thickened portion S1 of the thin piece S is no longer retained by the front end of the rail H. The recovery force of the compressed spring W pulls back the sliding piece L, the thin piece S, and the operation rod P. As a result, the starting piece 32' of the auxiliary device of the present invention is prevented from engaging the bevel gear 36' which is in high speed motion, as illustrated in FIG. 11.

When the operation rod is pushed forward, the connection rod C drives the starting device to attain the intended action. In the meantime, the compressed spring W located behind the sliding piece L is retained by the thin piece S and the front end of the rail H such that the compressed spring W reserves the spring force to pull the sliding piece L. When the propeller is operated in reverse so as to fill the cylinder with the forward pressure of the back fire. As the press piece PI of the operation rod P is pressed gently, the compressed spring W actuates the sliding piece L, the connection rod C and the starting piece 32' to retreat. The gear 36' is thus relieved of the locking force, thereby resulting in the automatic start of the engine.

The embodiments of the present invention described above are to be regarded in all respects as being merely illustrative and not restrictive. Accordingly, the present invention may be embodied in other specific forms without deviation from the spit thereof. The present invention is therefore to be limited only by the scopes of the following appended claims.

What is claimed is:

1. A starting device of a toy engine powered by high pressure gas, said starting device intended to control the start of a propeller and a piston of the toy engine and formed of a base, a starting piece, a spring, a fastening element, a control rod member, and a unidirectional bevel gear, said starting piece and said spring being fastened with said base which is in turn fastened with a top of a front end of a main body of the toy engine and is provided with two holes opposite in location to each other such that one of said two holes is used to fasten said starting piece, and that other one of said two holes is used to fasten a spring fastening block, with said spring being fasten between said starting piece and said spring fastening block, said bevel gear being fastened with the propeller and provided with teeth tilted toward a direction whereby said bevel gear is retained by said starting piece such that said bevel gear turns in a direction opposite to the direction toward which the teeth of said bevel gear are tilted, said control rod member being disposed on a top of said starting piece for controlling the disengagement of said starting piece with said bevel gear.

2. The starting device as defined in claim 1, wherein said unidirectional bevel gear has teeth depending on the requirement of design and comprises a single indentation.

3. The starting device as defined in claim 1, wherein said control rod member comprises an operation rod, a slide rail, an inverted U-shaped sliding piece, and a compression spring, said slide rail being mounted on said base, said sliding piece being slidably mounted on said slide rail and provided at a rear end thereof with a hook which is engaged with one end of said compression spring, said sliding piece provided at a front end thereof with a thin piece extending therefrom and having a thickened portion engageable with a front end of said slide rail, said thin piece provided thereon with a tilted operation rod whereby said operation rod has a press piece and fastened with a rear end of a connection rod which is in turn fastened at a front end thereof with a top of said starting piece.

4. A propeller clutch in cooperation with said starting device as defined in claim 1, said propeller clutch formed of two clutch pieces symmetrical with each other, with one of said two clutch pieces being fastened with a head of a toy airplane such that said one clutch piece is fastened with a propeller shaft for imparting an engine power, with other one of said two clutch pieces being fastened in front of the propeller whereby said two clutch pieces are detachably engaged.

* * * * *